United States Patent [19]

Yabuki et al.

[11] Patent Number: 4,640,891

[45] Date of Patent: Feb. 3, 1987

[54] HEAT DEVELOPABLE LIGHT-SENSITIVE MATERIAL

[75] Inventors: Yoshiharu Yabuki; Kozo Sato; Ken Kawata; Hiroyuki Hirai, all of Kanagawa, Japan

[73] Assignee: Fuji Photo Film Co., Ltd., Kanagawa, Japan

[21] Appl. No.: 768,655

[22] Filed: Aug. 23, 1985

[30] Foreign Application Priority Data

Aug. 24, 1984 [JP] Japan ..... 59-175123

[51] Int. Cl.[4] ..... G03C 1/06; G03C 5/24

[52] U.S. Cl. ..... 430/551; 430/617; 430/619; 430/620; 430/955; 430/151; 430/171; 430/179; 430/495; 430/570; 430/559; 430/561; 430/562; 430/563

[58] Field of Search ..... 430/617, 619, 455, 151, 430/179, 495, 171, 570, 620, 551, 559, 561, 562, 563

[56] References Cited

U.S. PATENT DOCUMENTS 4,487,826 12/1984 Watanabe et al. ..... 430/151
4,514,493 4/1985 Hirai et al. ..... 430/353
4,560,763 12/1985 Sato et al. ..... 430/151

FOREIGN PATENT DOCUMENTS 998949 7/1965 United Kingdom ..... 430/151

*Primary Examiner*—Won H. Louie
*Attorney, Agent, or Firm*—Sughrue, Mion, Zinn, Macpeak, and Seas

[57] ABSTRACT

A heat developable light-sensitive material having an excellent stability with time and capable of providing a high quality image is disclosed, which contains a base precursor represented by the following general formula (I):

(I)

wherein

A represents an organic residue represented by the following formula (II):

(II)

X represents an electron attractive substituent having a Hammett's sigma value of more than 0;

l represents an integer of 1 to 5 and, when l represents 2 or more, a plurality of Xs may be the same or different;

Y represents a substituent having a Hammett's sigma value of 0 or less;

k represents an integer of 0 to 5 and, when k represents 2 or more, a plurality of Ys may be the same or different;

Z represents a divalent organic residue selected from the group consisting of —C=C—, —O—, —S—, and —NR— (wherein R represents a hydrogen atom or a substituent selected from the group consisting of an alkyl group, an alkenyl group, an aralkyl group, an aryl group, and an acyl group);

the broken line in the general formula (II) represents that the cyclic compound containing Z may optionally be fused with a benzene ring;

B represents a mono- or diacidic base having a pKa value of 7 or more and containing 12 or less carbon atoms; and n and m represent an integer of 1 or 2 and are in such relation that the number of positive charge is equal to that of negative charge.

21 Claims, No Drawings

HEAT DEVELOPABLE LIGHT-SENSITIVE MATERIAL

FIELD OF THE INVENTION

This invention relates to a heat developable light-sensitive material. More particularly, it relates to a heat developable light-sensitive material containing a novel base precursor.

BACKGROUND OF THE INVENTION

In general, bases are desirably used in heat developable light-sensitive materials for accelerating heat development and in order to enhance stability of the light-sensitive material, bases must be used in the form of a precursor (which means in this specification a compound capable of being decomposed by heat to release a basic component). Bases practically suitable for such use must possess both stability at ordinary temperatures and rapid decomposability upon being heated.

As conventionally known base precursors, there are ureas as described in U.S. Pat. No. 2,732,299 and Belgian Pat. No. 625,554, urea or ammonium salts between urea and weak acids (Japanese Patent Publication No. 1699/65), hexamethylenetetramine or semicarbazides (U.S. Pat. No. 3,157,503), a combination of triazine compounds and carboxylic acids (U.S. Pat. No. 3,493,374), dicyandiamide derivatives (U.S. Pat. No. 3,271,155), N-sulfonyl-ureas (U.S. Pat. No. 3,420,665), amineimides (*Research Disclosure,* 1977, RD-15776), salts of thermally decomposable acids represented by trichloroacetic acid (British Pat. No. 998,949), etc.

However, image forming materials (using these compounds as base precursors have the essential defect that they fail to satisfy the aforementioned requirements of high stability at ordinary temperatures and rapid decomposability upon development processing. Therefore, images with a seriously reduced S/N ratio result due to low image density or due to release of the base during storage.

SUMMARY OF THE INVENTION

It is, therefore, an object of the present invention is to provide a heat developable light-sensitive material which has an excellent stability with time, and which can provide a high quality image.

Another object of the present invention is to provide a light-sensitive material containing a novel base precursor which is effective particularly for forming an image with high density and low fog.

A further object of the present invention is to provide a heat developable light-sensitive material which can provide an image having high density in a short time.

The above described and other objects of the present invention are attained by a heat developable light-sensitive material comprising a support having thereon at least one heat developable light-sensitive layer wherein the light-sensitive material contains a base precursor represented by the following general formula (I):

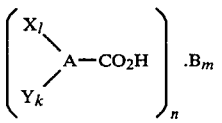

(I)

wherein

A represents an organic residue represented by the following general formula (II):

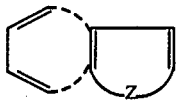

(II)

X represents an electron attractive substituent having a Hammett's sigma value of more than 0;

l represents an integer of 1 to 5 and when l represents 2 or more, a plurality of Xs may be the same or different;

Y represents a substituent having a Hammett's sigma value of 0 or less;

k represents an integer of 0 to 5 and when k represents 2 or more, a plurality of Ys may be the same or different;

Z represents a divalent organic residue selected from the group consisting of —C=C—, —O—, —S—, and —NR— (wherein R represents a hydrogen atom or a substituent selected from the group consisting of an alkyl group having preferably 1 to 20 carbon atoms, an alkenyl group having preferably 1 to 20 carbon atoms, an aralkyl group, an aryl group and an acyl group);

the broken line in the general formula (II) represents that the cyclic compound containing Z may optionally be fused with a benzene ring;

B represents a mono- or diacidic base having a pKa value of 7 or more and containing 12 or less carbon atoms; and n and m represent an integer of 1 or 2 and are in such relation that the number of positive charge is equal to that of negative charge, with l being preferably larger than k.

DETAILED DESCRIPTION OF THE INVENTION

The base precursor represented by the general formula (I) of the present invention is described in detail below.

Preferable examples of X include a halogen atom (e.g., a chlorine atom or a bromine atom), a nitro group, a cyano group, an alkylsulfonyl group having preferably 1 to 20 carbon atoms (e.g., a methylsulfonyl group or an ethylsulfonyl group), an arylsulfonyl group (e.g., a phenylsulfonyl group), an acyl group (e.g., an acetyl group), a sulfamoyl group, a substituted sulfamoyl group (e.g., a methylsulfamoyl group or a phenylsulfamoyl group), a caramoyl group, a substituted carbamoyl group (e.g., a methylcarbamoyl group or a phenylcarbamoyl group), an alkylsulfinyl group having preferably 1 to 20 carbon atoms (e.g., a methylsulfinyl group or an ethylsulfinyl group), an arylsulfinyl group (e.g., a phenylsulfinyl group, —$CO_2H$.B (wherein B represents the base component described hereinbefore), an alkoxycarbonyl group (e.g., a methoxycarbonyl group or an ethoxycarbonyl group), an aryloxycarbonyl group (e.g., a benzoxycarbonyl group), etc. Of these substituents, the most preferable are a nitro group, a cyano group, an alkylsulfonyl group having 1 to 8 carbon atoms, and an arylsulfonyl group. The alkyl or aryl moiety of these substituents may further have a substituent or substituents. l particularly preferably represents 2 or 3.

Examples of the substituent, Y, include an alkyl group having preferably 1 to 8 carbon atoms (e.g., a methyl group or an ethyl group), an alkoxy group having preferably 1 to 8 carbon atoms (e.g., a methoxy group or an ethoxy group), etc., with k being preferably 0.

The base moiety, B, represents a mono- or diacidic organic base having a pKa value of 7 or more, preferably that which has a pKa value of 9 or more and a boiling point of 100° C. or above, most preferably that which has a pKa value of 10 or more and is substantially non-volatile and not smelly at ordinary temperatures, and includes guanidines, cyclic guanidines, amidines, cyclic amidines, etc. Further, base moiety B desirably has hydrophilic properties, and those having totally 10 or less carbon atoms are preferably used. Preferable examples of base moiety B are illustrated below.

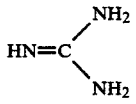

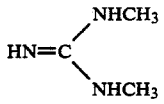

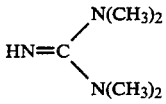

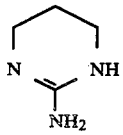

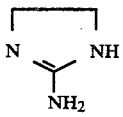

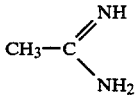

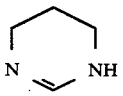

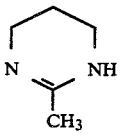

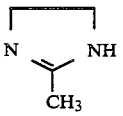

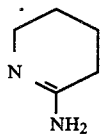

-continued

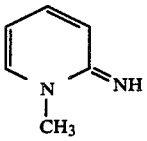

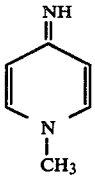

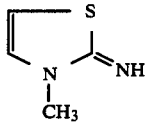

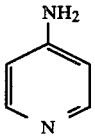

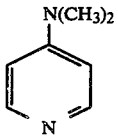

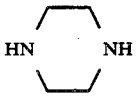

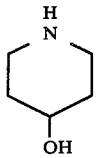

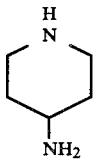

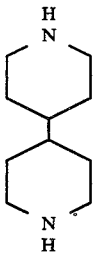

-continued

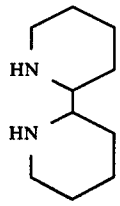

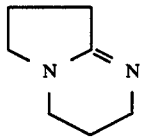

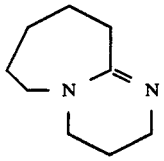

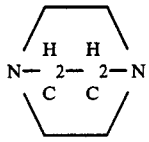

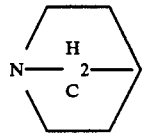

$(CH_3)_4NOH$

Examples of A include an organic residue derived from benzene, naphthalene, furan, benzofuran, pyran, benzopyran, thiophene, benzothiophene, pyrrole, pyrroline and indole.

The base precursor of the present invention is structurally characterized in that the carboxyl group in the acid moiety is bound to an aryl or a heterocyclic group substituted by an electron attractive group, whereby the carboxyl group is made extremely easy to be decarboxylated. However, the base precursors are extremely stable at ordinary temperatures and upon being heated they undergo decarboxylation to release a base component. As a result, both stability during storage at ordinary temperature and rapidly decomposable properties (to release the base) upon development processing required for base precursors can be obtained. Thus, the base precursors of the present invention enables the attainment of excellent heat developable image forming materials thereby overcoming the defects of the conventional image forming materials.

The base precursor of the present invention can be used in a wide range of amounts. Usually, it is used in an amount of from about 0.001 to about 50 wt % based on the weight of a dry coating of a light-sensitive material, with an amount of about 0.01 to 40 wt % being preferable.

Specific examples of the base precursors of the present invention are illustrated below.

(1)

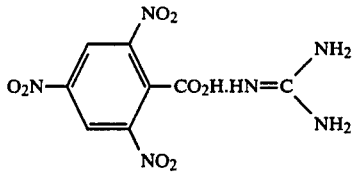

(2)

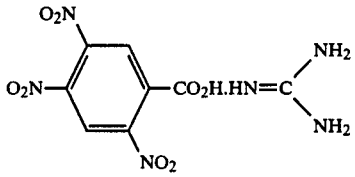

(3)

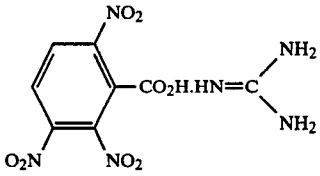

(4)

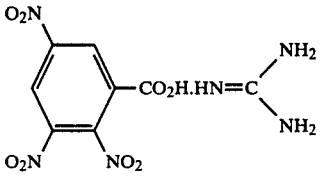

(5)

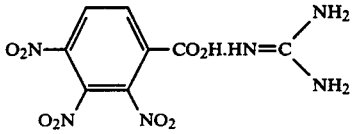

(6)

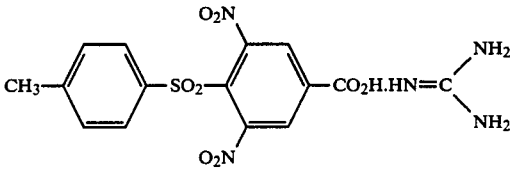

(7)

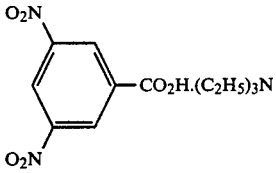

(8)

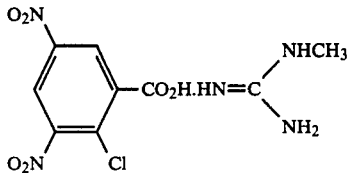

(9)

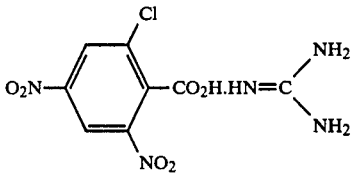

-continued (10)

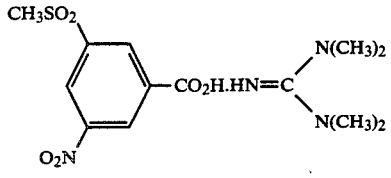

(11)

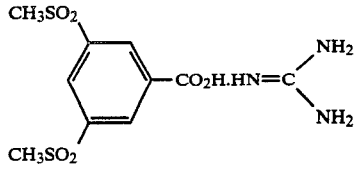

(12)

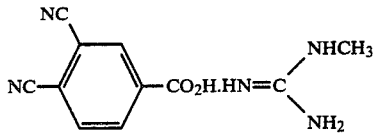

(13)

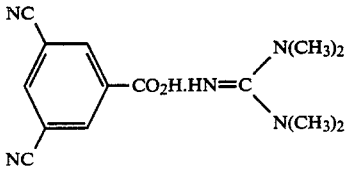

(14)

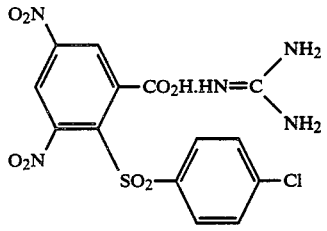

(15)

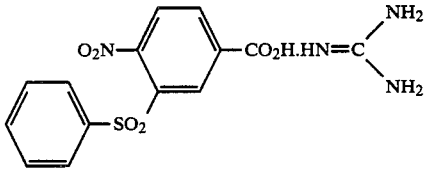

(16)

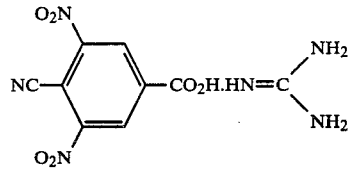

(17)

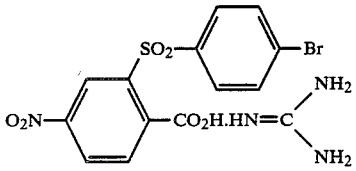

(18)

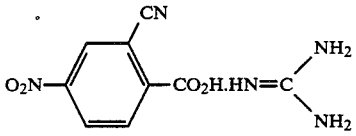

-continued (19)

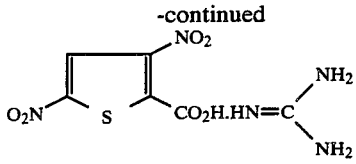

(20)

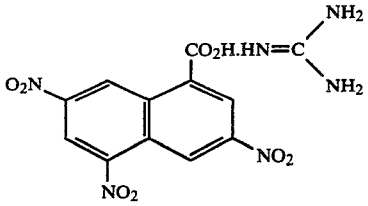

(21)

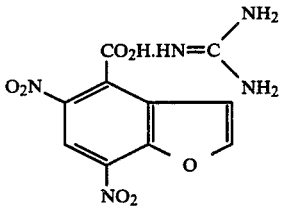

The base precursors of the present invention can be synthesized by first synthesizing the acid moiety, then neutralizing it to convert to its salt.

The acid moiety is synthesized according to processes which are known in the literature: For example, illustrative Compound (1) is synthesized according to the process described in *Org. Synth. Coll.*, Vol. 1, 543 and illustrative Compound (7) according to the process described in *Chemical Abstracts* (C.A.), 49, 13928g. Other literature referred to for synthesizing the acid moiety are given below:

*Gazz. Chim. Ital.*, 45, pp. 348 and 350 (1915),

*J. Chm. Soc.*, pp. 895 and 905 (1957),

*Collect. Czech. Chem. Commun.*, 40 (10), p. 3009 (1975), and

*C.A.*, 85, 12351m.

The base precursor of the present invention is preferably used in the form of salt from the first, but it is also possible to use the acid moiety and the base moiety in separate form and cause a neutralization reaction therebetween in a binder to prepare the salt in situ.

Any unit and layer structure can be applied to the light-sensitive material of the present invention. The base precursor may be incorporated into any one of various layers of the light-sensitive material. When a light-sensitive emulsion layer and a layer containing a dye providing substance are separately constructed, the base precursor may be incorporated into any of these layers. Further, it can be incorporated into an interlayer or a protective layer.

Moreover, two or more base precursors according to the present invention can be used.

The base precursor of the present invention exhibits superior effects when a silver halide emulsion is used as a light-sensitive substance.

The silver halide used in the present invention can be any conventional light-sensitive silver halide, including silver chloride, silver chlorobromide, silver chloroiodide, silver bromide, silver iodobromide, silver chloroiodobromide and silver iodide.

Any conventional process for preparing those silver halides can be used, such as a typical method of preparing silver iodobromide by first adding a silver nitrate solution to a potassium bromide solution to form silver bromide particles and then adding potassium iodide to the mixture.

Two or more silver halides in which the particle size and/or halogen composition are different from each other may be used in combination.

The average particle size of the silver halide used in the present invention is preferably from about 0.001 μm to 10 μm and more preferably from about 0.001 μm to 5 μm.

The silver halide used in the present invention may be chemically sensitized with a conventional chemical sensitizing agent such as compounds of sulfur, selenium or tellurium, or compounds of gold, platinum, palladium, rhodium or iridium, a reducing agent such as tin halide, or a combination thereof. The details of suitable sensitization methods are described in T. H. James, *The Theory of the Photographic Process,* pages 149 to 169 (4th Ed., 1977).

A suitable coating amount of the light-sensitive silver halide of the present invention is from about 1 mg to 10 $g/m^2$ calculated as silver.

The base precursor of the present invention is especially effective when it is employed together with a spectrally sensitized light-sensitive silver halide emulsion, and in particular, the degree of increase in image density is particularly large in this case.

The spectral sensitization of silver halide emulsions can be performed using methine dyes or other dyes. Suitable dyes which can be employed include cyanine dyes, merocyanine dyes, complex cyanine dyes, complex merocyanine dyes, holopolar cyanide dyes, hemicyanine dyes, styryl dyes and hemioxonol dyes. Of these dyes, cyanine dyes, merocyanine dyes and complex merocyanine dyes are particularly useful. Any conventionally utilized nucleus for cyanine dyes, such as a basic heterocyclic nucleus, is applicable to dyes useful in the present invention, including a pyrroline nucleus, an oxazoline nucleus, a thiazoline nucleus, a pyrrole nucleus, an orazole nucleus, a thiazole nucleus, a selenazole nucleus, an imidazole nucleus, a tetrazole nucleus or a pyridine nucleus. Furthermore, nuclei formed by condensing alicyclic hydrocarbon rings with these nuclei and nuclei formed by condensing aromatic hydrocarbon rings with these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus may also be used. The carbon atoms of these nucleu may be substituted.

In merocyanine dyes and complex merocyanine dyes, nuclei having a ketomethylene structure can include 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus or a thiobarbituric acid nucleus.

These sensitizing dyes can be employed individually and can also be employed in combination thereof. A combination of sensitizing dyes is often used, particularly for the purpose of supersensitization.

Useful sensitizing dyes include those described in German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

A suitable amount of the sensitizing dye to be used is from about 0.001 g to 20 g, and preferably from about 0.01 g to 2 g, per 100 g of silver contained in the emulsion.

In a particularly preferred embodiment of the heat developable light-sensitive material according to the present invention, an organic silver salt oxidizing agent is used together with silver halide. The organic silver salt oxidizing agent is a silver salt which forms a silver image by reacting with the hereinafter described reductive dye providing substance or with optional reducing agents present together with the image forming substances, when it is heated to a temperature of above about 80° C. and preferably above about 100° C. in the presence of exposed silver halide. Combined use of such an organic silver salt oxidizing agent, the light-sensitive material which provides higher color density can be obtained.

The silver halide used in conjunction with an organic silver salt oxidizing agent does not necessarily contain pure silver iodide crystal in the case of using the silver halide alone. Any silver halide which is known in the art can be used.

Examples of such organic silver salt oxidizing agents include those described in U.S. Pat. No. 4,500,626, and specifically include the following.

A silver salt of an organic compound having a carboxy group can be used, including a silver salt of an aliphatic carboxylic acid and a silver salt of an aromatic carboxylic acid.

In addition, a silver salt of a compound containing a mercapto group or a thione group or a derivative thereof can be used.

Further, a silver salt of a compound containing an imino group can be used, including a silver salt of benzotriazole and a derivative thereof described in Japanese Patent Publication No. 30270/69 and U.S. Pat. No. 3,635,719, e.g., a silver salt of benzotriazole, a silver salt of an alkyl-substituted benzotriazole such as a silver salt of methylbenzotriazole, a silver salt of a halogen-substituted benzotriazole such as a silver salt of 5-chlorobenzotriazole, a silver salt of carboimidobenzotriazole such as a silver salt of butylcarboimidobenzotriazole, a silver salt of 1,2,4-triazole or 1-H-tetrazole as described in U.S. Pat. No. 4,220,709, a silver salt of carbazole, a silver salt of saccharin, a silver salt of imidazole and an imidazole derivative.

Moreover, a silver salt as described in *Research Disclosure,* Vol. 170, No. 17029 and an organic metal salt such as copper stearate can be used as organic metal salt oxidizing agents in the present invention.

Methods of preparing these silver halide and organic silver salt oxidizing agents and methods of blending them are described in *Research Disclosure,* No. 17029, Japanese Patent Application (OPI) Nos. 42529/76, 13224/74 and 17216/75 (the term "OPI" as used herein refers to a "published unexamined Japanese patent application") and U.S. Pat. Nos. 3,700,458 and 4,076,539.

A suitable coating amount of the light-sensitive silver halide and the organic silver salt oxidizing agent employed in the present invention is a total of from about 50 $mg/m^2$ to 10 $g/m^2$ calculated as silver.

In the present invention, a wide variety of image forming substances can be used in addition to silver as an image forming substance.

For instance, couplers capable of forming color images by bonding to oxidation products of developing agents employed in conventional liquid development processing can be used in the present invention, with specific examples including magenta couplers such as 5-pyrazolone couplers, pyrazolobenzimidazole couplers, cyanoacetylcumarone couplers and open chain acylacetonitrile couplers, yellow couplers such as acylacetamide couplers (e.g., benzoylacetanilides and pivaloylacetanilides), and cyan couplers such as naphthol couplers and phenol couplers.

It is generally desirable that these couplers should be rendered nondiffusible by a hydrophobic group (i.e., a "ballast group") in their molecules, or that the couplers should be polymeric couplers. The couplers may be either 4-equivalent or 2-equivalent with respect to silver ion. Further, these couplers may be colored couplers having a color correction effect, or couplers capable of releasing development inhibitors upon development (i.e., "DIR couplers").

In addition, dyes which can produce positive color images using light-sensitive silver dye bleach processes, for example, dyes described in *Research Disclosure,* pages 30 to 32, RD-14433 (April, 1976), *Research Disclosure,* pages 14 and 15, RD-15227 (December, 1976), and U.S. Pat. No. 4,235,957, and leuco dyes described in U.S. Pat. Nos. 3,985,565 and 4,022,617, can be used.

Also, dyes into which nitrogen-containing heterocyclic groups are introduced described in *Research Disclosure,* pages 54 to 58, RD-16966 (May, 1978) can be used.

Moreover, dye providing substances described in European Pat. Nos. 67,455 and 79,056, West German Pat. No. 3,217,853, which release mobile dyes by a coupling reaction with reducing agents oxidized by a redox reaction with silver halide or organic silver salt oxidizing agents under high temperatures, and dye providing substances described in European Pat. Nos. 66,282 and 76,492, West German Pat. No. 3,215,485, and Japanese Patent Application (OPI) Nos. 154445/84 and 152440/84, which undergo a redox reaction with silver halide or organic silver salt oxidizing agents under high temperatures, and release mobile dyes as a result of this reaction, can be used.

Dye providing substances which can be used in the above described processes are preferably represented by the following formula (CI):

$$(\text{Dye}-\text{X})_q-\text{Y} \qquad \text{(CI)}$$

wherein Dye represents a dye which becomes mobile when it is released from the molecule of the compound represented by the formula (CI); X represents a simple bond or a connecting group; q represents 1 or 2 and when q represents 2, Dye—X may be the same or different; and Y represents a group which releases Dye in correspondence or counter-correspondence to light-sensitive silver salts having a latent image distributed imagewise, the diffusibility of a dye released being different from that of the compound represented by $(\text{Dye}-\text{X})_q-\text{Y}$.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes. These dyes can also be used in a color-shifted form having temporarily shorter wavelengths, the original color of which is recoverable in development processing.

More specifically, dyes described in European Pat. No. 76,492 can be utilized.

Examples of the connecting group represented by X include —NR— (wherein R represents a hydrogen atom, an alkyl group, or a substituted alkyl group), $-SO_2-$, —CO—, an alkylene group, a substituted alkylene group, a phenylene group, a substituted phenylene group, a naphthylene group, a substituted naphthylene group, —O—, —SO—, or a group containing two or more of the foregoing groups in combination.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

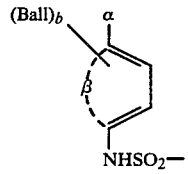

(CII)

wherein $\beta$ represents non-metallic atoms necessary for forming a benzene ring, which may optionally be condensed with a carbon ring or a hetero ring to form, for example, a naphthalene ring, a quinoline ring, a 5,6,7,8-tetrahydronaphthalene ring, a chroman ring or the like;

$\alpha$ represents a group of $-OG^{11}$ or $-NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

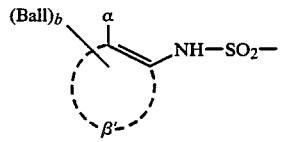

(CIII)

wherein Ball, $\alpha$ and b are the same as defined with (CII), $\beta'$ represents atoms necessary for forming a carbon ring (e.g., a benzene ring which may be condensed with another carbon ring or a hetero ring to form a naphthalene ring, quinoline ring, 5, 6, 7, 8-tetrahydronaphthalene ring, chroman ring or the like. Specific examples of this type of Y are described in Japanese Patent Application (OPI) Nos. 113624/76, 12642/81, 16131/81, 16130/81, 4043/82 and 650/82 and U.S. Pat. No. 4,053,312.

Further examples of Y suited for this type of compound are those represented by the following formula (CIV):

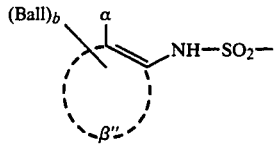

(CIV)

wherein Ball, $\alpha$ and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japenese Patent Application (OPI) No. 104343/76.

Still further examples of Y suited for this type of compound are those represented by the following formula (CV):

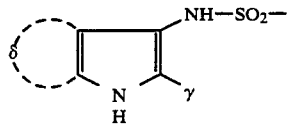

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

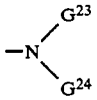

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a condensed benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

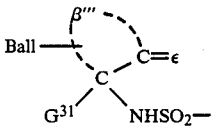

(CVI)

wherein Ball is the same as defined with the formula (CII); $\epsilon$ represents an oxygen atom or $=NG^{32}$ (wherein $G^{32}$ represents hydroxyl or an optionally substituted amino group) (examples of $H_2N$—$G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

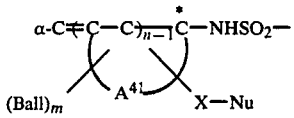

(CVII)

wherein $\alpha$ represents $OR^{41}$ or $NHR^{42}$; $R^{41}$ represents hydrogen or a hydrolyzable component; $R^{42}$ represents hydrogen, an alkyl group containing 1 to 50 carbon atoms or a hydrolyzable group; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of Y are described in Japanese Patent Applicatien (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

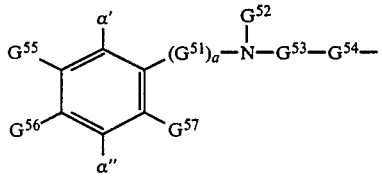

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

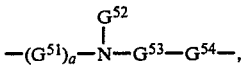

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

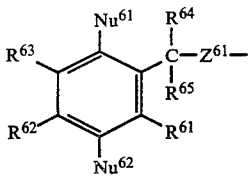

(CIX)

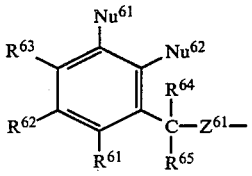

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a condensed ring together with the rest of the molecule, or R62 and $R^{63}$ may form a condensed ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

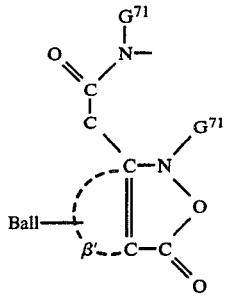

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

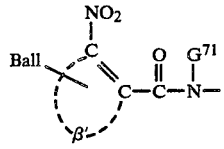

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

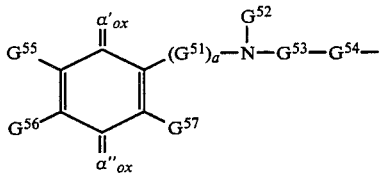

(CXIII)

wherein $\alpha'_{ox}$ and $\alpha''_{ox}$ represents groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

(CXIV-A)

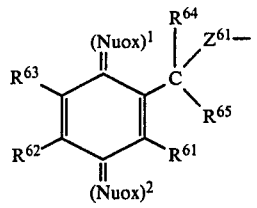

(CXIV-B)

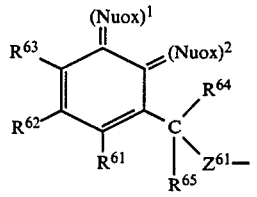

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

(CXV)

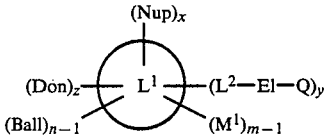

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred examples thereof, only a portion thereof is described hereinafter. Specific examples of the dye providing substances represented by general formula (CI) are set forth below.

(1)

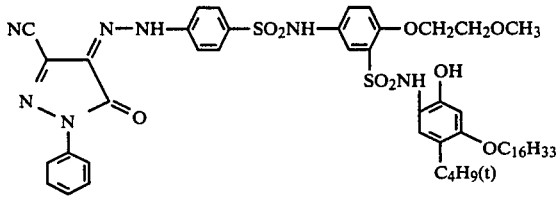

(2)

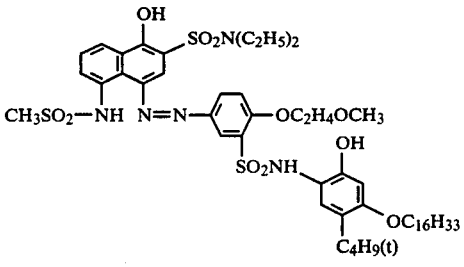

(3)

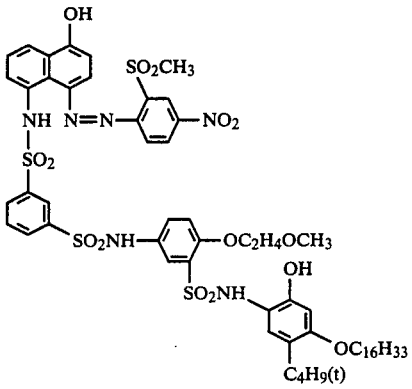

(4)

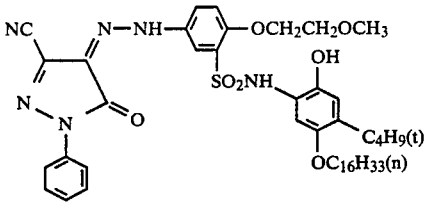

(5)

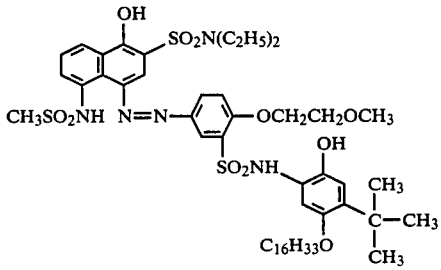

-continued
(6)
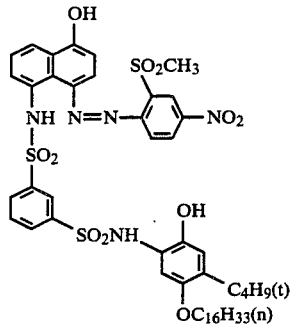
(7)
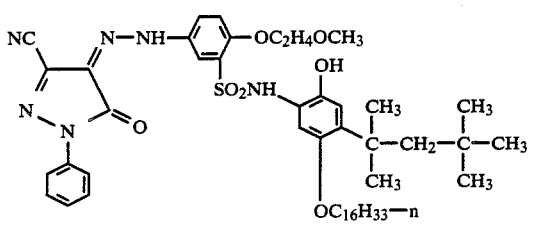
(8)
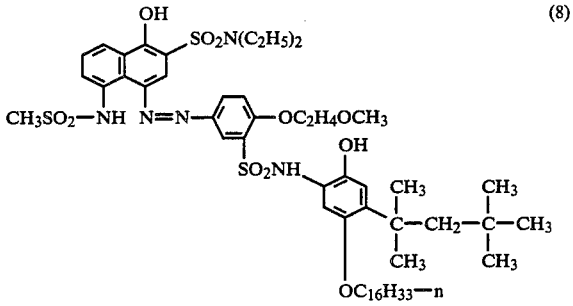
(9)
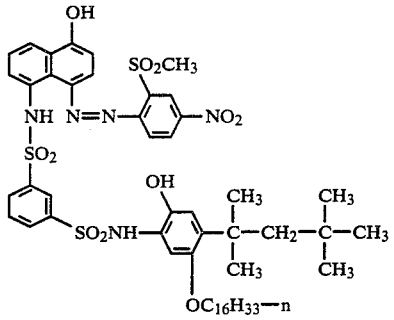
(10)
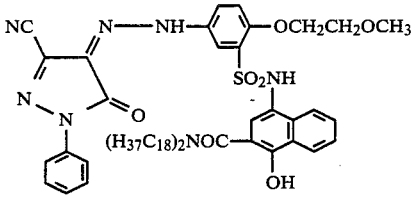
-continued
(11)
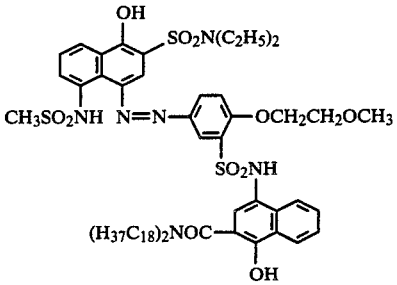
(12)
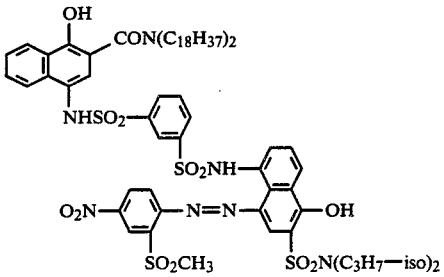
(13)
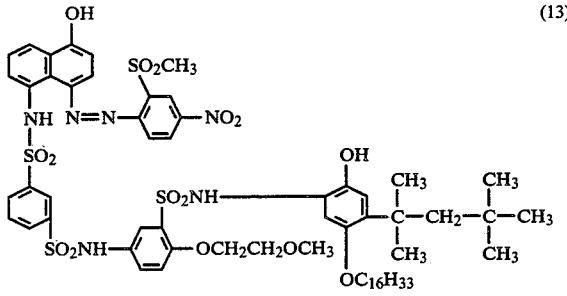
(14)
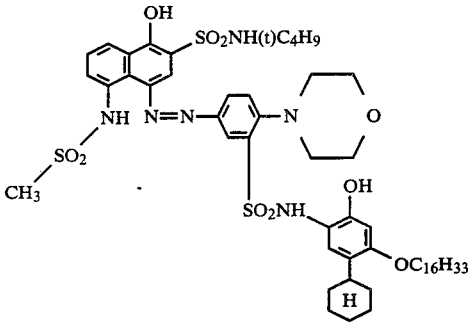
(15)
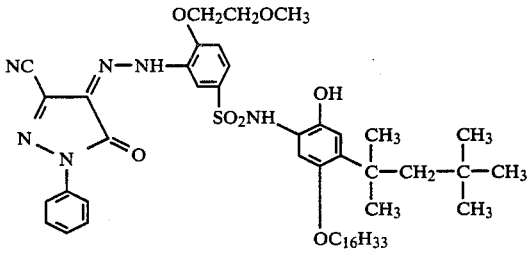

-continued

CI-16

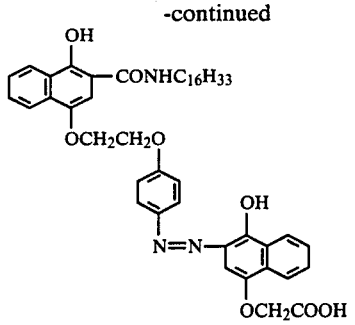

The above described compounds are only given as examples and the present invention should not be construed as being limited thereto.

Many of the above described substances form an imagewise distribution of mobile dyes corresponding to exposure in a light-sensitive material by heat development, and methods for transferring these image dyes into a dye fixing material (so-called diffusion transfer) to produce images are described in the above described patents and Japanese Patent Application (OPI) Nos. 168439/84 and 182447/84.

The dye providing substance used in the present invention can be introduced into a layer of the light-sensitive material by known methods such as the method as described in U.S. Pat. No. 2,322,027, such as by using an organic solvent having a high boiling point or an organic solvent having a low boiling point as described in the Examples.

For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used. An amount of high boiling point organic solvent used in the present invention is 10 g or less, and preferably 5 g or less, per gram of the dye providing substance.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention various dye releasing activators can be used. These dye releasing activators of the present invention are compounds which are basic and are capable of accelerating development, or so-called nucleophilic compounds. Namely, bases or base precursors are used.

Although base precursors of the present invention can be used as a dye releasing activator, other bases or base precursors can also be incorporated.

The dye releasing activator can be incorporated in the light-sensitive material or a dye fixing material. In the case that the dye releasing activator is incorporated in the light-sensitive material, it is advantageous to use a base precursor.

In the present invention various development stopping agents can be used in order to always obtain constant image regardless of any changes of processing temperature and processing time in heat development.

These development stopping agents mean compounds capable of neutralizing a base or capable of reacting with a base to reduce the basicity in layer immediately after completion of appreprate development. In the concrete, acid precursors releasing an acid by heating, or compounds reacting with a base coexisting by heating are used as a development stopping agent. For example, the embodiments of the acid precursor include oxime esters as described in Japanese Patent Application Nos. 216928/83 and 48305/84, and compounds releasing an acid due to Lossen rearrangement as described in Japanese Patent Application No. 85834/84. The compounds reacting with a base by heating are described in Japanese Patent Application No. 85836/84.

When base precursors are used, the most excellent effect of a development stopping agent is obtained. In that case, the mole ratio of a base precursor/an acid precursor is from 1/20 to 20/1, and preferably from 1/5 to 5/1.

The binder which can be used in the present invention can be employed alone or in a combination thereof. A hydrophilic binder can be used as the binder according to the present invention. The typical hydrophilic binder is a transparent or translucent hydrophilic binder, examples of which include a natural substance, for example, protein such as gelatin, a gelatin derivative, etc., a polysaccharide such as starch, gum arabic, a cellulose derivative, etc., and a synthetic polymer, for example, a water-soluble polyvinyl compound such as polyvinyl alcohol, polyvinylpyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trichloroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichlcroacetate, etc., as described in U.S. Pat. No. 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

Furthermore, it is also preferred to use azolthioether and blocked azoline thione compound as described in Belgian Pat. No. 768,071, 4-aryl-1-carbamyl-2-tetrazoline-5-thione compound as described in U.S. Pat. No. 3,893,859, and compounds as described in U.S. Pat. Nos. 3,839,041, 3,844,788 and 3,877,940.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include sunlight, flash lamp, strobo light, tungsten lamps, mercury lamps, halogen lamps such as iodine lamps, xenon lamps, laser light sources, CRT light sources, plasma light sources, fluorescent tubes and light emitting diodes, etc.

In the present invention, after the heat developable color photographic material is exposed to light, the resulting latent image can be developed by heating the whole material to a suitably elevated temperature.

As the heating means, a simple heat plate, iron, heat roller, heat generator utilizing carbon or titanium white, etc., or analogues thereof may be used.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbcnate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing, material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinyl-sulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, antihalation and anti-irradiation dyes, hardeners, mordants and so on, are those described in U.S. Pat. Nos. 4,500,626, 4,478,927, 4,463,079 and Japanese Patent Application No. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

The heat developable light-sensitive material of the present invention has an extremely good shelf stability since a base precursor which does not show basic properties and is stable at ordinary temperatures is used as a base component upon development. The base precursor is rapidly decomposed by heat to release a base, and hence the heat developable light-sensitive material containing the base precursor provides images having high density and excellent quality, by short time development.

The present invention is now illustrated in greater detail by reference to the following examples which, however, are not to be construed as limiting the present invention in any way.

Unless otherwise specified, all percents, ratios, etc., are by weight.

EXAMPLE 1

Preparation of Silver Bromoiodide Emulsion 40 g of gelatin and 26 g of potassium bromide were dissolved in 3,000 ml of water, and this solution was kept at 50° C. under stirring. Then, a solution of 34 g of silver nitrate in 200 ml of water and 200 cc of a solution prepared by dissolving 0.02 g of Dye (I) to be described hereinafter in 300 cc of methanol were simultaneously added to the above described solution for 10 minutes, followed by adding thereto a solution of 3.3 g of potassium iodide in 100 ml of water for 2 minutes.

The pH of the thus prepared silver bromoiodide emulsion was adjusted to flocculate and, after removal of excess salts, the pH was adjusted to 6.0 to obtain 400 g of a silver bromoiodide emulsion.

Dye (I)

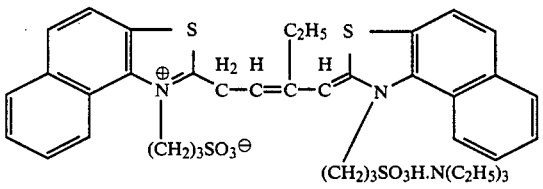

Preparation of Gelatin Dispersion of Coupler 5 g of 2-dodecylcarbamoyl-1-naphthol, 0.5 g of sodium 2-ethylhexyl sulfosuccinate, and 2.5 g of tricresyl phosphate (TCP) were weighed, and 30 ml of ethyl acetate was added thereto and dissolved. The resulting solution was stirred and mixed with 100 g of a 10% solution of gelatin, then dispersed in a homogenizer for 10 minutes at 10,000 rpm.

Preparation of Light-Sensitive Material

The coating solution prepared according to the following formulation was coated on a polyethylene terephthalate support in a wet thickness of 60 μm, then dried to prepare a light-sensitive material.

| | | |
|---|---|---|
| (a) | Silver bromoiodide emulsion | 10 g |
| (b) | Gelatin dispersion of coupler | 3.5 g |
| (c) | Illustrative Base Precursor (1) of this specification | 0.26 g |
| (d) | Gelatin (10% aqueous solution) | 5 g |
| (e) | A solution of 0.2 g of 2,6-dichloro-p-aminophenol in 17 cc of water | |

This light-sensitive material was imagewise exposed for 5 seconds with an illuminance of 2,000 lux using a tungsten lamp, then uniformly heated for 20 seconds on a 150° C. heat block to obtain a negative cyan color image. Image density of the image was measured by means of a Macbeth transmission densitometer (TD-504) to obtain a minimum density of 0.29 and a maximum density of 2.08. These results demonstrate that the base precursor of the present invention imparts high image density.

EXAMPLE 2

The same silver bromoiodide emulsion as used in Example 1 and the following dispersion of a dye providing substance were used.

Preparation of the Dispersion of Dye Providing Substance 5 g of Dye Image Providing Substance (2) illustrated in this specification, 0.5 g of sodium 2-ethylhexyl sulfosuccinate as a surfactant, and 5 g of tricresyl phosphate (TCP) were weighed, and 30 ml of ethyl acetate was added thereto, and the resulting mixture was heated to about 60° C. to prepare a uniform solution. This solution was mixed with 100 g of a 10% gelatin aqueous solution under stirring, then dispersed for 10 minutes at 10,000 rpm in a homogenizer.

Preparation of Light-Sensitive Material

| | | |
|---|---|---|
| (a) | Light-sensitive silver bromoiodide emulsion (described in Example 1) | 25 g |
| (b) | Dispersion of Dye Providing Substance (2) | 33 g |
| (c) | 5% Aqueous solution of the following compound: | 10 ml |

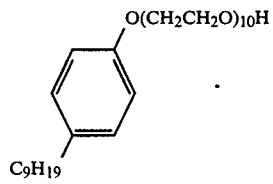

| | | |
|---|---|---|
| (d) | 10% Aqueous solution of $H_2NSO_2N(CH_3)_2$ | 4 ml |

-continued

| | | |
|---|---|---|
| (e) | Base Precursor (1) illustrated in this specification | 2.5 g |
| (f) | Water | 20 ml |

The above described ingredients (a) to (f) were mixed and heated to prepare a solution. Then, the solution was coated on a polyethylene terephthalate film in a wet thickness of 30 $\mu$ m. After being dried, this sample was imagewise exposed for 10 seconds with an intensity of 2,000 lux using a tungsten bulb, then uniformly heated for 20 seconds on a 150° C. heat block. This sample was referred to as Sample A.

A comparative sample B, prepared by using 1.8 g of guanidine trichloroacetate in place of ingredient (e) in Sample A, was subjected to the same procedures as described above.

Preparation of Image Receiving Material Having an Image Receiving Layer 10 g of poly(methyl acrylate-co-N,N,N-trimethyl-N-vinylbenzylammonium chloride) (methyl acrylate/-vinylbenzylammonium chloride ratio by mol=1:1) was dissolved in 200 ml of water, then uniformly mixed with 100 g of 10% lime-processed gelatin. This mixture solution was uniformly coated in a wet thickness of 90 $\mu$m on a paper support laminated with polyethylene containing titanium dioxide dispersed therein. After being dried, this sample was used as an image receiving material.

Each of the above described heated Light-Sensitive Materials A and B was superposed on the image receiving material having been dipped in water in such manner that the coated surfaces were in contact with each other. Each of the resulting assemblies was heated for 6 seconds on an 80° C. heat block, then the image receiving material was peeled apart from the light-sensitive material to obtain a negative magenta color image on the image receiving material. The densities of the negative images were measured by using a Macbeth reflection densitometer (RD-519) to obtain the following results.

| Sample | Maximum Density | Minimum Density |
|---|---|---|
| A (Present Invention) | 1.92 | 0.19 |
| B (Comparative Sample) | 2.14 | 0.58 |

From the above results, it is demonstrated that the base precursors of the present invention give high maximum density and low minimum density.

Further, when these samples were processed in the same manner as described hereinbefore after being stored for 2 days at 60° C., Sample A gave almost the same image of 1.98 in maximum density and 0.28 in minimum density as that described above, whereas Sample B suffered fogging all over. This result demonstrates the extremely improved preservability of the light-sensitive material of the present invention.

EXAMPLE 3

Absolutely the same procedures as described in Example 2 were conducted except for using the following base precursors to obtain the results tabulated in Table 1.

TABLE 1

| Sample | Base Precursor No. (illustrative No. in this specification) | Amount Added (g) | Image Density of Fresh Light-Sensitive Material | | Image Density of Light-Sensitive Material Having Been Heated at 60° C. for 2 Days | |
|---|---|---|---|---|---|---|
| | | | Dmax | Dmin | Dmax | Dmin |
| C | 6 | 3.4 | 1.91 | 0.14 | 1.94 | 0.24 |
| D | 7 | 2.5 | 1.81 | 0.11 | 1.83 | 0.19 |
| E | 14 | 3.6 | 1.89 | 0.13 | 1.95 | 0.21 |
| F | 16 | 2.4 | 1.93 | 0.14 | 1.95 | 0.26 |

EXAMPLE 4

An example of using an organic silver salt oxidant is described below.

Preparation of Benzotriazole Silver Salt Emulsion 28 g of gelatin and 13.2 g of benzotriazole were dissolved in 3,000 ml of water, and this solution was stirred while being kept at 40° C. A solution of 17 g of silver nitrate in 100 ml of water was added to this solution for 2 minutes, then the pH of the solution was adjusted to flocculate and remove excess salts. Then, the pH was adjusted to 6.0 to obtain 400 g of a benzotriazole silver salt emulsion.

The following light-sensitive coating composition was prepared using the resulting benzotriazole silver salt emulsion.

| | | |
|---|---|---|
| (a) | Silver bromoiodide emulsion (described in Example 1) | 20 g |
| (b) | Benzotriazole silver salt emulsion | 10 g |
| (c) | Dispersion of a dye providing substance (described in Example 2) | 33 g |
| (d) | 5% Aqueous solution of the following compound: | 10 ml |

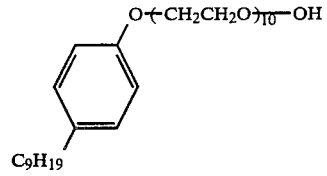

| | | |
|---|---|---|
| (e) | 10% Aqueous solution of $H_2NSO_2N(CH_3)_2$ | 4 ml |
| (f) | Illustrative Precursor (1) of this specification | 2.8 g |
| (g) | Gelatin dispersion of the following acid precursor | 8 ml |
| (h) | Water | 12 ml |

The gelatin dispersion of acid precursor (g) described above was prepared as follows.

10 g of the compound shown below was added to 100 g of a 1% aqueous solution of gelatin, then milled for 10 minutes in a mill using 100 g of glass beads having an average particle size of about 0.6 mm. Then, the glass beads were separated by filtration to obtain a gelatin dispersion of the acid precursor.

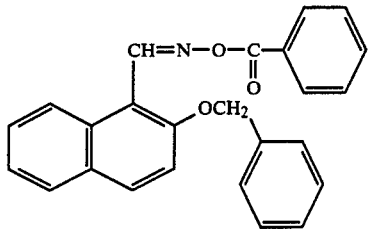

After mixing the above described ingredients (a) to (h), subsequent procedures were conducted in absolutely the same manner as in Example 2 to obtain the sample of the present invention, followed by processing the sample in the same manner as in Example 2. A comparative sample was also prepared by using 1.8 g of guanidine trichloroacetate in place of ingredient (f) in the above sample and processed in the same manner as in Example 2. The results thus obtained are tabulated below.

| Sample | Maximum Density | Minimum Density |
|---|---|---|
| Present Invention | 2.15 | 0.16 |
| Comparative Sample | 2.33 | 0.61 |

Further, when these samples were processed in the same manner after being stored for 2 days at 60° C., the sample of the present invention provided a maximum density of 2.16 and a minimum density of 0.22, whereas the comparative sample suffered fogging all over. These results demonstrate that preservability of the light-sensitive material of the present invention is extremely excellent.

EXAMPLE 5

Preparation of a Benzotriazole Silver Salt Emulsion Containing Light-Sensitive Silver Bromide 10 g of gelatin and 6.5 g of benzotriazole were dissolved in 1,000 ml of water, and this solution was stirred while keeping it at 50° C. A solution of 8.5 g of silver nitrate in 100 ml of water was added thereto for 2 minutes.

Then, a solution of 1.2 g of potassium bromide in 50 ml of water was added thereto for 2 minutes. The pH of the thus prepared emulsion was adjusted to flocculate and remove excess salts. Then, the pH was adjusted to 6.0 to obtain 200 g of a benzotriazole silver salt emulsion.

Preparation of a Gelatin Dispersion of a Dye Providing Substance 10 g of the dye providing substance of the following structure, 0.5 g of sodium 2-ethylhexyl sulfosuccinate, and 4 g of tricresyl phosphate (TCP) were weighed, and 20 ml of cyclohexanone was added thereto, followed by heating the mixture to about 60° C. to prepare a uniform solution. This solution was stirred and mixed with 100 g of a 10% gelatin solution, then dispersed in a homogenizer for 10 minutes at 10,000 rpm.

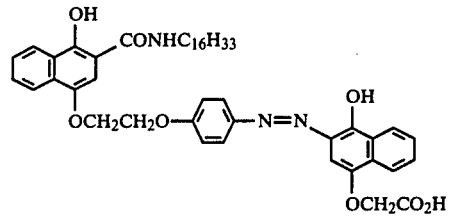

Preparation of a Light-Sensitive Coating Composition

| | |
|---|---|
| (a) Benzotriazole silver salt emulsion containing light-sensitive silver bromide | 10 g |
| (b) Dispersion of dye providing substance | 3.5 g |
| (c) Illustrative Base Precursor (1) of this specification | 0.26 g |
| (d) Gelatin (10% aqueous solution) | 5 g |
| (e) A solution prepared by dissolving 200 mg of 2,6-dichloro-4-aminophenol in 4 ml of methanol | |

The above described ingredients (a) to (e) were mixed and heated to prepare a solution. Then, this solution was coated in a wet thickness of 30 μm on a 180 μm thick polyethylene terephthalate film. After being dried, this sample was imagewise exposed for 5 seconds with an illuminance of 2,000 lux using a tungsten bulb, then uniformly heated for 20 seconds on a heat block heated to 150° C.

As an image receiving material, that described in Example 2 was used, and a negative magenta color image was formed on the image receiving material by processing in the same manner. The density of this negative image was measured to obtain a maximum density of 1.96 and a minimum density of 0.21.

These results demonstrate the exellent effects of the compound of the present invention.

EXAMPLE 6

Preparation of a Gelatin Dispersion of a Dye Providing Substance

To 5 g of the dye providing substance of the following structure:

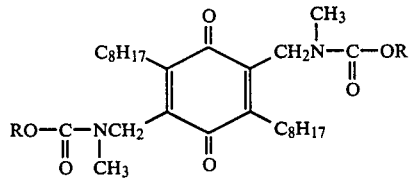

wherein R represents a group having the following structure:

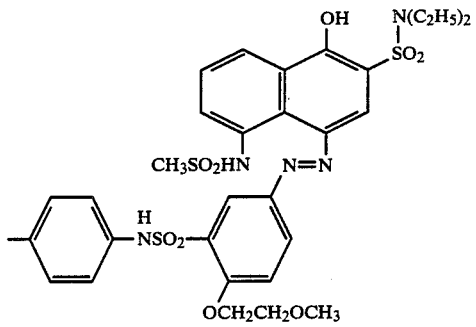

4 g of the electron donative substance of the following structure:

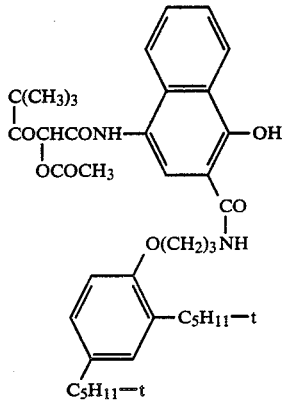

0.5 g of sodium 2-ethylhexyl sulfosuccinate, and 10 g of tricresyl phosphate (TCP) was added to 20 ml of cyclohexanone, then heated to about 60° C. to prepare a uniform solution. This solution was stirred and mixed with 100 g of a 10% gelatin solution, then dispersed for 10 minutes at 10,000 rpm in a homogenizer.

Preparation of a Light-Sensitive Coating Solution

| | | |
|---|---|---|
| (a) | Benzotriazole silver salt emulsion containing light-sensitive silver bromide (described in Example 4) | 10 g |
| (b) | Dispersion of dye providing substance (prepared in this Example) | 3.5 g |
| (c) | Illustrative Precursor (1) of this specification | 0.37 g |
| (d) | 5% Aqueous solution of the following compound: | 1.5 ml |

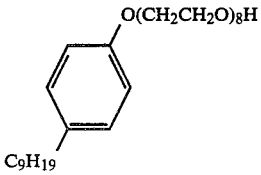

4 ml of water was added to a mixture of the above described ingredients (a) to (d) and, after heating to prepare a solution, the resulting solution was coated in a wet thickness of 30 μm on a polyethylene terephthalate film and dried to prepare a light-sensitive material.

The thus obtained light-sensitive material was imagewise exposed for 10 seconds with an illuminance of 2,000 lux using a tungsten bulb, then uniformly heated for 40 seconds on a 140° C. heat block.

The thus heated light-sensitive material was superposed on the image receiving material described in Example 2 having been dipped in water in such manner that the coated surfaces came into contact with each other. The density of the positive magenta image formed on the image receiving material was measured by using a Macbeth reflection densitometer (RD-519) to obtain a maximum density of 1.95 and a minimum density of 0.29 for green light.

These results demonstrate the effectiveness of the base precursor of the present invention.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon at least one heat developable light-sensitive layer comprising a silver halide emulsion and a reducing agent, wherein said light-sensitive material contains a base precursor represented by the following general formula (I):

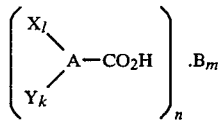

(I)

wherein

A represents an organic residue represented by the following general formula (II):

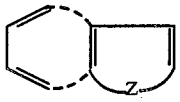

(II)

—$CO_2H$ of formula (I) is bonded to a skeletal carbon atom of the organic residue represented by the formula (II);

X represents an electron attractive substituent having a Hammett's sigma value of more than 0;

L represents an integer of 1 to 5 and, when represents 2 or more, a plurality of Xs may be the same or different;

Y represents a substituent having a Hammett's sigma value of 0 or less;

k represents an integer of 0 to 5 and, when k represents 2 or more, a plurality of Ys may be the same or different;

Z represents a divalent organic residue selected form the group consisting of —C=C—, —O—, —S— and —NR—, wherein R represents a hydrogen atom or a substituent selected from the group consisting of an alkyl group, an alkenyl group, an aralkyl group, an aryl group and an acyl group;

the broken line in the general formula (II) represents that the cyclic compound containing Z may be optionally fused with a benzene ring;

B represents a mono- or diacidic base having a pKa value of 7 or more and containing 12 or less carbon atoms; and n and m represent an integer of 1 or 2 and are in such relation that the number of positive charge is equal to that of negative charge.

2. A heat developable light-sensitive material as claimed in claim 1, wherein X represents a halogen atom, a nitrol group, a cyano group, an alkylsulfonyl group, an arylsulfonyl group, an acyl group, a sulfamoyl group, a substituted sulfamoyl group, a carbamoyl group, a substituted carbamoyl group, an alkylsulfinyl group, an arylsulfinyl group, an alkoxycarbonyl group, an aryloxycarbonyl group or —$CO_2H.B$ (wherein B has the same definition as defined in claim 1).

3. A heat developable light-sensitive material as claimed in claim 1, wherein X represents a nitro group, a cyano group, an alkylsulfonyl group or an arylsulfonyl group.

4. A heat developable light-sensitive material as claimed in claim 1, wherein Y represents an alkyl group or an aryl group.

5. A heat developable light-sensitive material as claimed in claim 1, wherein A represents an organic residue derived from benzene, naphthalene, furan, benzofuran, pyran, benzopyran, thiophene, benzothiophene, pyrrole, pyrroline or indole.

6. A heat developable light-sensitive material as claimed in claim 1, wherein B represents a mono- or diacidic base having a pKa value of 9 or more and a boiling point of 100° C. or above.

7. A heat developable light-sensitive material as claimed in claim 1, wherein B represents guanidines, cyclic guanidines, amidines or cyclic amidines.

8. A heat developable light-sensitive material as claimed in claim 1, wherein R represents an integer of 2 or 3, and k represents 0.

9. A heat developable light-sensitive material as claimed in claim 1, wherein said base precursor is present in an amount of from about 0.001 to 50% by weight based on the weight of a dry coating of the light-sensitive material.

10. A heat developable light-sensitive material as claimed in claim 1, wherein said base precursor is present in an amount of from about 0.01 to 40% by weight based on the weight of a dry coating of the light-sensitive material.

11. A heat developable light-sensitive material as claimed in claim 1, wherein the silver halide emulsion is a spectrally sensitized silver halide emulsion.

12. A heat developable light-sensitive material as claimed in claim 1 wherein the silver halide emulsion is spectrally sensitized by using a sensitizing dye.

13. A heat developable light-sensitive material as claimed in claim 1, wherein the light-sensitive layer further contains an organic silver salt oxidizing agent.

14. A heat developable light-sensitive material as claimed in claim 1, wherein the light-sensitive layer further contains an image forming substance.

15. A heat developable light-sensitive material as claimed in claim 14, wherein the image forming substance is a coupler capable of forming a color image by bonding to an oxidation product of a developing agent.

16. A heat developable light-sensitive material as claimed in claim 14, wherein the image forming substance is a dye providing substance.

17. A heat developable light-sensitive material as claimed in claim 16 wherein the dye providing substance is a compound represented by the following formula (CI):

$$(\text{Dye—X})_q\text{—Y} \qquad \text{(CI)}$$

wherein Dye represents a dye capable of becoming mobile when it is released from the molecule of the compound represented by the formula (CI); X represents a simple bond or a connecting group; q represents 1 or 2; and Y represents a group which releases Dye in correspondence or countercorrespondence to light-sensitive silver salts having a latent image distributed imagewise, the diffusibility of Dye released being different from that of the compound represented by $(\text{Dye—X})_q$—Y.

18. A heat developable light-sensitive material as claimed in claim 17, wherein Dye represents a dye having a hydrophilic group.

19. A heat developable light-sensitive material as claimed in claim 17, wherein the dye represented by Dye is an azo dye, an azomethine dye, an anthraquinone dye, a naphthoquinone dye, a styryl dye, a nitro dye, a quinoline dye, a carbonyl dye or a phthalocyanine dye.

20. A heat developable light-sensitive material as claimed in claim 17, wherein the connecting group represented by X is —NR— wherein R represents a hydrogen atom, an alkyl group, or a substituted alkyl group, —$SO_2$—, —CO—, an alkylene group, a substituted alkylene group, a phenylene group, a substituted phenylene group, a naphthylene group, a substituted naphthylene group, —O—, —SO—, or a group containing two or more of the foregoing groups in combination.

21. A heat developable light-sensitive material as claimed in claim 16, wherein the light-sensitive layer further contains a dye releasing activator.

* * * * *